US005152410A

United States Patent [19]

Ta et al.

[11] Patent Number: 5,152,410

[45] Date of Patent: Oct. 6, 1992

[54] ELECTRO-PNEUMATIC COUPLER CONTROL SYSTEM FOR ENSURING THE SAFE UNCOUPLING OF RAILWAY VEHICLES

[75] Inventors: Cuong M. Ta, Taylors; Steven C. Rumsey, Greer, both of S.C.

[73] Assignee: Westinghouse Air Brake Company, Wilmerding, Pa.

[21] Appl. No.: 756,697

[22] Filed: Sep. 9, 1991

[51] Int. Cl.[5] ..... B61G 1/08; B61G 1/16; B61G 3/08

[52] U.S. Cl. ..... 213/212

[58] Field of Search ..... 213/1.6, 115, 159, 211, 213/212

[56] References Cited

U.S. PATENT DOCUMENTS

| | | | |
|---|---|---|---|
| 3,532,228 | 10/1970 | Beyer | 213/76 X |
| 3,599,803 | 8/1971 | Cope | 213/212 X |
| 3,690,469 | 9/1972 | Nagoya et al. | 213/212 |
| 3,724,680 | 4/1973 | Hines | 213/212 |
| 3,743,111 | 7/1973 | Shimada et al. | 213/212 |
| 4,049,128 | 9/1977 | Jeffrey | 213/212 X |
| 4,892,204 | 1/1990 | Lumbis | 213/1.6 |

*Primary Examiner*—Robert J. Oberleitner
*Assistant Examiner*—Kevin D. Rutherford
*Attorney, Agent, or Firm*—John B. Sotak

[57] ABSTRACT

An automatic car coupler control system for a railway train consisting of at least one powered car and at least two nonpowered cars. An electrical switch and a timer carried by the nonpowered car following the powered car is connected to a voltage source located on the powered car. An electrical switch and a timer carried by a subsequent nonpowered car is connected through the electrical switch of the nonpowered car following the powered car. The timers of each of the nonpowered cars is connected to a plurality of electromagnetic valves which pneumatically actuate the head pistons of the couplers when the nonpowered cars meet and which initially pneumatically actuate the head pistons and the head unlocks of the coupler and which subsequently pneumatically activate a latch cylinder on the coupler on the nonpowered car following the powered car when the nonpower cars are uncoupled by actuating the electrical switch on the nonpowered car following the powered car.

14 Claims, 3 Drawing Sheets

ELECTRO-PNEUMATIC COUPLER CONTROL SYSTEM FOR ENSURING THE SAFE UNCOUPLING OF RAILWAY VEHICLES

FIELD OF THE INVENTION

This invention relates to a safety control system which is interlocked to only permit the railway vehicles to be uncoupled in a certain manner and, more particularly, to an automatic electro-pneumatic railway car coupler control arrangement which ensures that an uncoupling sequence can only be initiated from a railway car which immediately follows the locomotive or powered car in order to make sure that the railway cars which stay behind will go into an emergency braking state to prevent the uncoupled cars from inadvertently rolling away.

BACKGROUND OF THE INVENTION

Generally, automatic car couplers used on mass and/or rapid transit railway vehicles not only effect the mechanical coupling and uncoupling operations between adjacent cars, but also perform the connecting and disconnecting operations of the electrical contacts of the trainline circuits and various pressure connectors of the pneumatic lines of the train. In practice, a coupler control circuit for a married pair of self-powered transit cars usually permits the uncoupling operation to be initiated at either of the railway cars. In operation, the trainman powers up the transit car that he wishes to pull away and then he initiates the uncoupling sequence by closing an electrical switch. The car on which the uncoupling procedure is activated will be free to move away while the left-behind car will go into an emergency operating mode in which the brakes are set. However, this indiscriminate method of uncoupling is not only unsafe, but also troublesome on certain transit trains, such as, unpowered passenger cars which are pulled by a locomotive. This is true, especially when the uncoupling must be initiated outside the transit cars, such as, the double deck passenger cars which are used on some properties. When the individual, who performs the uncoupling operation between two unpowered trailing cars, activates the uncoupling on a trailing car which is not directly connected to the powered locomotive, then it is possible for the uncoupled car to drift and roll away if it is located on an inclined section of track. Further, the coupled cars which remain connected to the locomotive will go into an emergency braking in which the brakes become set. This is contrary to what should actually happen. In practice, the passenger car which remains coupled to the locomotive should be free to be pulled away while the uncoupled cars should have their brakes set.

OBJECTS AND SUMMARY OF THE INVENTION

Accordingly, it is an object of this invention to provide a new and improved coupler control system for safely uncoupling railway cars from a train powered by a locomotive.

Another object of this invention is to provide a unique railway car coupler control arrangement in which an uncoupling operation can only be initiated from a car which is directly connected to a powered car or locomotive.

A further object of this invention is to provide a novel control system for railway vehicles having automatic couplers in which the brakes of the uncoupled cars are set and in which the coupled cars are free to be pulled away by the locomotive.

Still another object of this invention is to provide an automatic electro-pneumatic coupler control system which prohibits the uncoupling sequence to be initiated except from the passenger car which immediately follows the locomotive of a railway train.

Still a further object of this invention is to provide a coupler control arrangement having an interlock to prevent an uncoupling process to be initiated from railway vehicles which are not directly connected to the powered vehicle or locomotive.

Yet a further object of this invention is to provide an electro-pneumatic coupler control arrangement for safely uncoupling at least one railway car from the end of a train comprising, automatic coupler means carried by each railway car of the train for coupling the railway cars together, electrical means carried by each car of the train for supplying electrical power to the respective railway cars of the train, manually operated switching means carried by each railway car for interlocking the electrical means on each railway car, timing means carried by each railway car for energizing and deenergizing selected one of a plurality of electromagnetic valves when the automatic coupler means meet, and for establishing an uncoupling sequence when the manually operated switching means on the railway car next to the locomotive is actuated and for preventing an uncoupling operation when the manually operated switching means on a railway car remote from the locomotive is actuated so that no railway car remote from the locomotive is capable of rolling away from the end of the train.

Yet another object of this invention is to provide a control system for automatic railway car couplers comprising, an automatic coupler including a electrical portion and a pneumatic portion carried by each railway car of a train, a multiple contact switch connected to the electrical portion for supplying power to a timer means, said timer means connected to the coils of a plurality of electromagnetic valves which are connected to the pneumatic portion, said multiple contact switch on the railway car following a powered car connecting power to the multiple contact switch of subsequent railway cars so that at least one of the coils of the plurality of electromagnetic valves is energized when the couplers of adjacent cars meet to pneumatically pressurize a head piston on the respective railway cars to cause the railway cars to be coupled together, and said timer means on the respective railway cars sequentially energizing the other of the coils of said plurality of electromagnetic valves when an uncoupling operation is initiated by the manipulation of the multiple contact switch on the railway car following the powered car to pneumatically pressurize the head piston and a head unlock and also to pneumatically pressurize a latch cylinder to prevent the brakes on the railway car following the powered car from being applied and also for preventing the pneumatic pressurizing of a latch cylinder on the subsequent railway cars so that their brakes are applied.

DESCRIPTION OF THE DRAWINGS

The above objects and other attendant features and advantages will be more readily appreciated as the present invention becomes better understood by reference to the following detailed description when considered in conjunction with the accompanying drawings, wherein:

FIG. 1A is disposed on the left side and when FIG. 1B is disposed on the right side, of an automatic electro-pneumatic coupler control system for permitting the safe uncoupling of transit cars of a railway train.

DETAILED DESCRIPTION OF THE INVENTION

Figure 1A:
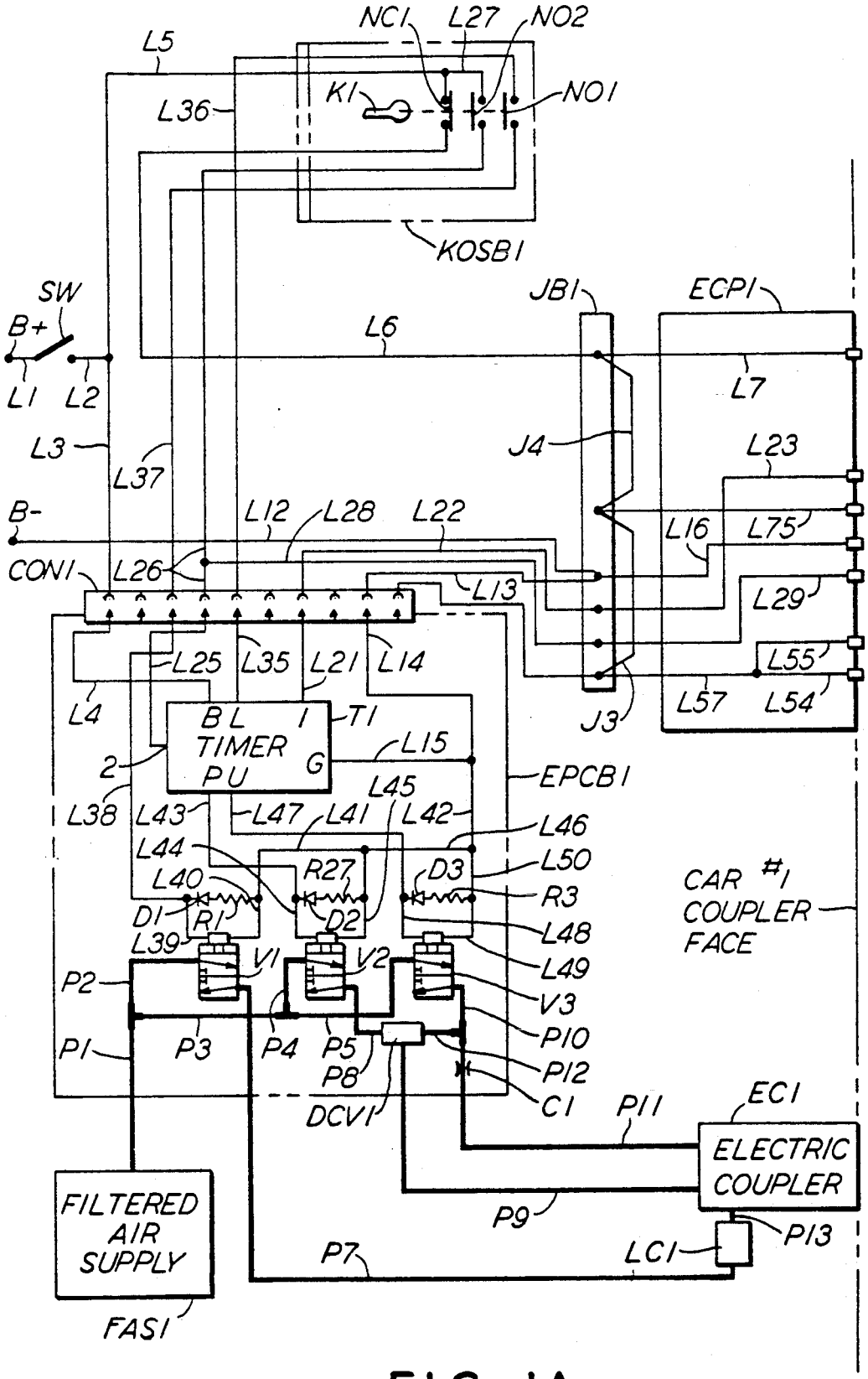
FIGS. 1A and 1B illustrate a schematic circuit diagram which, when placed in side-by-side relationship, namely, when
Figure 1B:
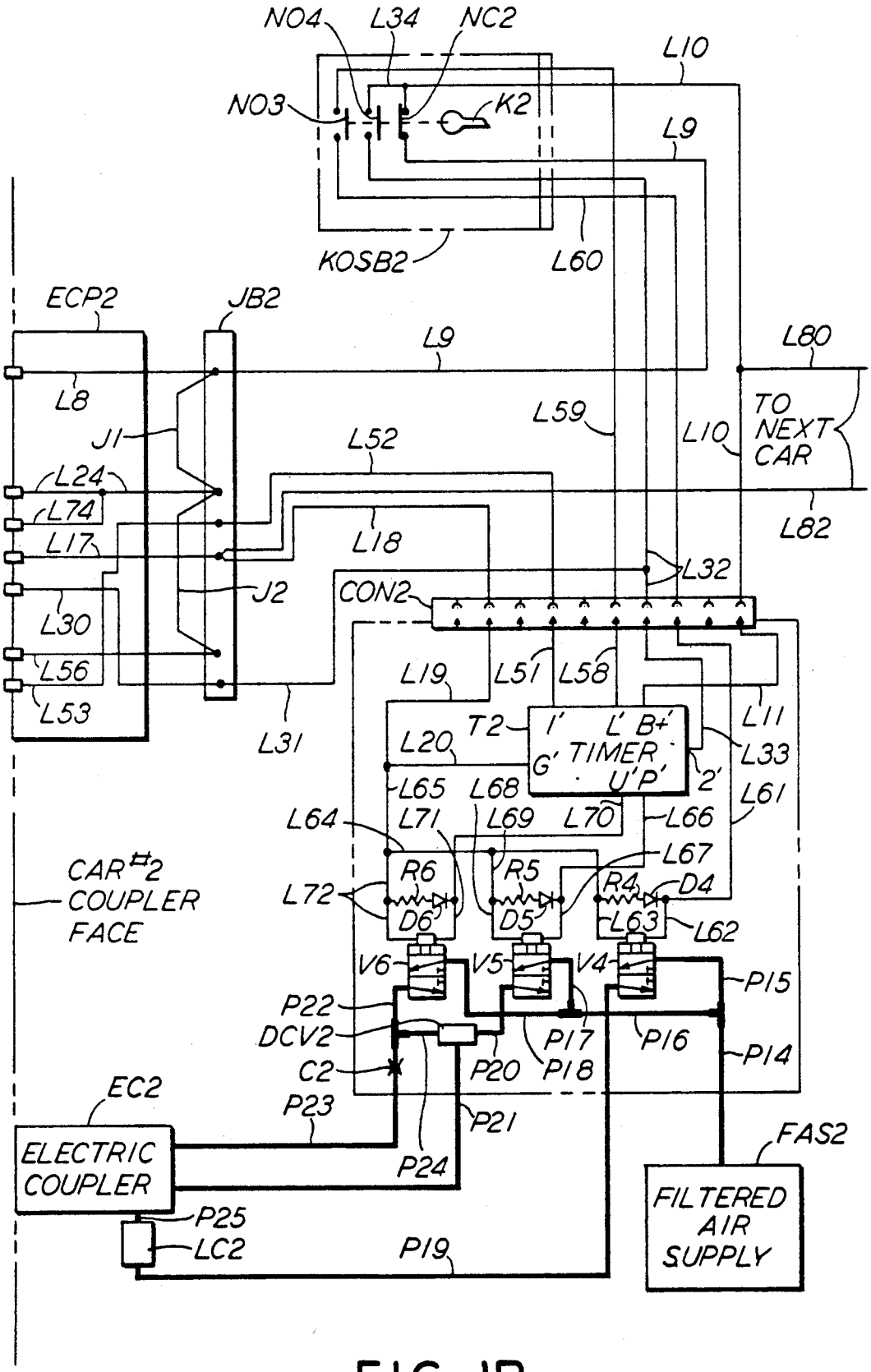

Referring now to the drawings, and in particular to FIGS. 1A and 1B, there is shown an electro-pneumatic coupler control arrangement for initiating the safe uncoupling of at least one transit car from a railway train. It will be seen that electrical power is conveyed to the voltage terminals B+ and B− from a suitable potential supply source located on the powered car or locomotive which pulls at least two nonpowered passenger transit cars. The mechanical, electrical, and pneumatic coupling equipment carried by car #1 is substantially identical to that carried by car #2 since the cars of the train makeup may be interchanged. As shown, a manually operable switch SW is located in the operator's cab of the locomotive which may be closed to supply B+ voltage to the railway cars. Additional cars may be included in the train consist, which would include similar equipment as shown on car #1 and car #2, but for simplicity of description only two cars will be shown and described. It will be seen that the coupler equipment on car #1 includes key operated switch box KOSB1, an electro-pneumatic control box EPCB1, an electrical contact portion ECP1, an electric coupler EC1, a latch cylinder LC1 and the necessary electrical wiring and pneumatic piping, as will be described in detail hereinafter. Likewise, it will be noted that the coupler equipment on car #2 includes a key operated switch box KOSB2, an electro-pneumatic control box EPCB2, an electrical contact portion ECP2, an electric coupler EC2 and the required electrical wiring and pneumatic piping which will be described hereinafter. It will be observed that the key operated switch box KOSB1 is a single-throw trip-pole switch which includes a plurality of electrical contacts, such as, a normal closed contact NC1 and a pair of normal opened contacts NO1 and NO2. The contacts NC1, NO1, and NO2 are ganged together and may be opened and closed by manually turning key K1. It will be noted that the electro-pneumatic control box EPCB1 includes an electric timer T1 which appropriately controls the electrical condition of each of the electromagnetic valves V1, V2, and V3 which are pneumatically connected to an electric coupler portion EC1 and a latch cylinder LC1. As shown, the key operated switch box KOSB2 is also a single-throw triple-pole switch which includes a plurality of electrical contacts, such as, a normal closed contact NC2 and a pair of normally opened contacts NO3 and NO4. The contacts NC2, NO3, and NO4 are linked together and may be opened and closed by manipulating the key K2. It will be seen that the electro-pneumatic control box EPCB2 includes an electric timer T2 which appropriately controls the electrical condition of the respective electromagnetic valves V4, V5 and V6 which are pneumatically connected to an electric coupler portion EC2 and a latch cylinder LC2.

The positive voltage terminal B+ is connected to one terminal of the switch SW via lead L1 while the other terminal of switch SW is connected to the terminal B of timer T1 via leads L2 and L3 through connector CON1 and lead L4. The other terminal of switch SW is also connected to one contact of the normally closed contact NC1 via leads L2 and L5. The other contact of the normally closed contact NC1 is connected by lead L5, through jumper block JB1, lead L7, through mating connectors of the electrical contact portions ECP1 and ECP2, lead L8, through jumper block JB2 and lead L9 to one contact of the normally closed contact NC2. The other contact of the normally closed contact NC2 is connected by lead L10, connector CON2 and lead L11 to the terminal B' of the timer T2. It will be seen that the negative voltage terminal B− is connected to the ground terminal G of the timer T1 via lead L12, jumper block JB1, lead L13 connector CON1 and leads L14 and L15 and is also connected to the ground terminal G of timer T2 via lead L12, jumper block JB1, lead L16, through mating connectors of the electrical contact portions ECP1 and ECP2, lead L17, jumper block JB2, lead L18, connector CON2 and leads L19 and L20.

It will be observed that the timer T1 also includes terminals 1, 2, L, P, and U while the timer T2 also includes electrical terminals 1', 2', L', P', and U'. The terminal 1 of timer T1 is connected via lead L21, connector CON1, lead L22, jumper block JB1, lead L23, mating connectors of electrical contact portion ECP1 and ECP2, lead L24, and jumper J1 to B+ lead L8. The terminal 2 of timer T1 is connected by lead L25, connector CON1 and lead L26 to one contact of the normally opened contact NO1 while the other contact of the normally opened contact NO1 is connected to lead L5 via lead L27. The terminal 2 of timer T1 is also connected to terminal 2' of timer T2 by lead 25, connector CON1, lead L28, jumper block JB1, lead L29, mating connectors of electrical contact portions ECP1 and ECP2, lead L30, jumper block JB2, leads L31 and L32, connector CON2 and lead L33. It will be seen that lead L32 is also connected to one contact of the normally opened contact NO4 while the other terminal of normally opened contact NO4 is connected to lead L10 via lead L34. The terminal L of timer T1 is connected to one contact of the normally opened contact NO1 via lead L35, connector CON1 and lead L36 while the other contact of the normally opened contact NO1 is connected to one end of the electrical coil of the electromagnetic valve V1 via lead L37, connector CON1 and leads L38 and L39. The other end of the coil of electromagnetic valve V1 is connected to ground lead L15 via leads L40, L41, L46, and L42. The coil of the electromagnetic valve V1 is shunted by a surge suppression resistor R1 and diode D1. As shown, the terminal P of the timer T1 is connected to one end of the electrical coil of the electromagnetic valve V2 via leads L43 and L44 while the other end of the electrical coil of the electromagnetic valve V is connected to ground lead L15 via leads L45, L46 and L42. The coil of the electromagnetic valve V2 is shunted by a surge suppression resistor R2 and diode D2. The terminal U of the timer T1 is connected to one end of the electrical coil of the electromagnetic valve V3 via leads L47 and L48 while the other end of the electrical coil of the electromagnetic valve V3 is connected to ground lead L15 via leads L49, L50, and L42. The coil of the electromagnetic valve V3 is connected in parallel a series connected surge suppressing resistor R3 and diode D3.

Referring now to timer T2, it will be seen that the terminal 1' is connected to the positive voltage B+ lead L8 via lead L51, connector CON2 lead L52, jumper block JB2, lead L53, the mating connectors of the electrical control portions ECP2 and ECP1, leads L54 and L55, mating connectors of the electrical control portions ECP1 and ECP2 lead 56 and jumper wires J2 and J1 while a parallel path is connected to the positive voltage B+ lead L6 via lead L57 and jumper wires J3 and J4. The terminal L' of the timer T2 is connected to one contact of the normally open contact NO3 via lead L58, connector CON2 and lead L59. The other contact of the normally opened contact NO3 is connected to lead L60, connector CON2 and leads L61 and L62 to one end of the electrical coil of the electromagnetic valve V4. The other end of the electrical coil of the electromagnetic valve V4 is connected to ground lead L20 via leads L63, L64 and L65. A series connected resistor R4 and diode D4 provide surge suppression for the coil of the electromagnetic valve V4. The terminal P' of the timer T2 is connected to one end of the electrical coil of the electromagnetic valve V5 via leads L66 and L67 while the other end of the electrical coil of the electromagnetic valve V5 is connected to ground lead L20 via leads L68, L69, L64 and L65. The coil of the electromagnetic valve V5 is shunted by the surge suppression resistor R5 and diode D5. The terminal U' of the timer T2 is connected to one end of the electrical coil of the electromagnetic valve V6 via leads L70 and L71 while the other end of the coil of the electromagnetic valve V6 is connected to ground lead L20 via leads L72 and L65. A series connected resistor R6 and diode D6 subdue surges that are developed in the coil of the electromagnetic valve V6.

Each of the electromagnetic valves V1, V2, V3, V4, V5, and V6 is identical in construction and is a two-way flow control device. When the electrical coils of the electromagnetic valves are deenergized, the valves assume the position as shown in FIGS. 1A and 1B in which the pneumatic pressure from suitable filter air supplies is normally blocked off. As shown in FIG. 1A, the pneumatic equipment for car #1 includes a source of filtered air supply FAS1 which is pneumatically connected to the inlet of valve V1 via conduits or pipes P1 and P2 and which is pneumatically connected to the inlet of valve V2 via pipes P1, P3, and P4. Similarly, the filter air supply FAS1 is connected to the input of valve V3 via pipes P1, P3 and P5. It will be seen that the outlet of valve V1 is connected to a latch cylinder LC1 via pipe P7. The outlet of valve V2 is connected to the head piston of the electric coupler EC1 via pipe P8, double check valve DCV1 and pipe P9 while the outlet of the valve V3 is connected to the head unlock of the electric coupler EC1 via pipe 10, choke C1 and pipe P11 and is also connected to the head piston of the electric coupler EC1 via pipes P10 and P12, double check valve DCV1 and pipe P9. The latch cylinder LC1 is connected by pipe P13 to a tappet brake valve located within the electric coupler EC1.

Referring to FIG. 1B, it will be seen that the pneumatic equipment for car #2 includes a source of filtered air supply FAS2 which is connected to the inlet of valve V4 via conduits of pipes P14 and P15. Similarly, the filtered air supply FAS2 is connected to the inlet of valve V5 via pipes P14, P16, and P17 while the filtered air supply FAS2 is connected to the inlet of valve V6 via pipes P14, P16 and P18. It will be seen that the outlet of valve V4 is connected to a latch cylinder LC2 via pipe P19. The outlet of valve V5 is connected to the head piston of the electric coupler EC2 via pipe P20, double check valve DCV2 and pipe 21 while the outlet of the valve V6 is connected to the head unlock of the electric coupler EC2 via pipe P22, chock C2, and pipe P23 and is also connected to the head piston of the electric coupler EC2 via pipes P22 and P24, double check valve DCV2 and pipe L21. The latch cylinder LC2 is connected by pipe P25 to a tappet brake valve located within the electric coupler EC2.

It will be appreciated that the electrical power leads L80 and L82 are available for interconnection to any subsequent car which may be coupled to car #2 of the railway train.

Figure 2:
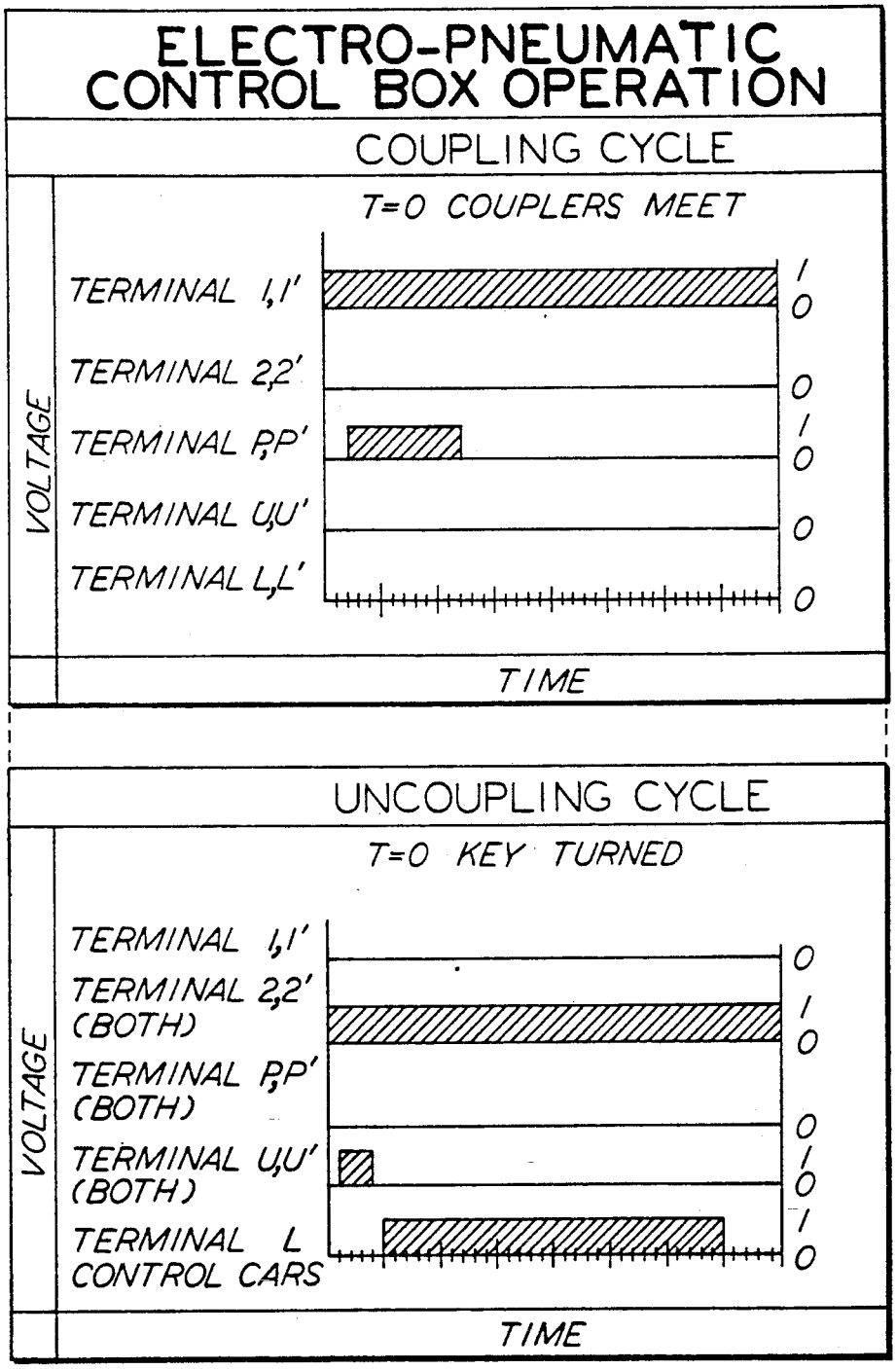
FIG. 2 is a graphical illustration of the operation of the electro-pneumatic control box of the coupler control system shown in FIG. 1.

In describing the operation, let us assume that the train is being made up for revenue service and that the locomotive or powered vehicle is moving into coupling position with the passenger cars or transit vehicles of the train consist. It will be seen from the upper portion of the graphical illustration of FIG. 2 that the sequence of the electro-pneumatic control box operation will commence when the couplers meet. When the vehicles are coupled together, the B+ voltage is supplied to the terminal 1 and 1' of each of the timers T1 and T2 after being looped through the various contacts of the electric couplers. This will ensure that a coupling will not begin until the electric couplers are connected together. After the terminals 1 and 1' of the timers are supplied with B+ voltage, a timing sequence is initiated as illustrated by the upper coupler functional diagram of FIG. 2. The terminals 1 and 1' will go high and assume a B+ voltage so long as the couplers are securely joined. After the expiration of two (2) seconds which assures the 20 couplers are securely coupled, the terminal P and P' of both car couplers will go high and assume a B+ voltage for ten (10) seconds which will cause the energization of the coils of the electromagnetic valves V2 and V5 which, in turn, causes air pressure to be supplied to the head pistons to advance and lock the electric contacts in the electric couplers EC1 and EC2. After the expiration of the ten (10) second time period, the terminals P and P' will go low and revert to a zero (0) voltage level so that the coils of electromagnetic valves V2 and V5 become deenergized and the air pressure to the head pistons of the electric couplers EC and EC2 is cut off. The terminals 1 and 1' of timers T1 and T2 will remain high so long as the railway cars are coupled together.

Now let us assume that it is determined to shorten the length of the train by uncoupling the last vehicle, namely, car #2. In order to effect a safe uncoupling of car #2, the key K1 of the switch box KOSB1 of car #1 is turned so that the normally closed contact NC1 is opened and the normally opened contacts NO1 and NO2 are closed. The opening of contact NC1 interrupts the B+ supply voltage; however, the closing of contact NO1 continues the supply of B+ voltage to cars #1 and #2. Thus, the B+ supply voltage is fed from closed contact NO1 through lead L26, connector CON1 and lead 25 to terminal 2 of timer T1 and is also fed from closed contact NO1 through leads L26 and L28, jumper block JB1, lead L29, mating connectors of electrical contact portions ECP1 and ECP2, lead L30, jumper block JB2, leads L31 and L32, connector CON2 and lead L33 to terminal 2' of timer T2. Thus, terminals 2 and 2' will go high or to a B+ voltage as shown in the lower portion of the graphical illustration of FIG. 2. Thus, both timers begin the timing sequence as shown in the uncoupling cycle of FIG. 2. After a one (1) second delay, the terminal U and U' of timers T1 and T2 will go high for three (3) seconds to energize the coils of electromagnetic valves V3 and V6. Thus, air pressure is supplied from the filtered air supply FAS1 through pipes P1, P3 and P5, through the open valve V3, through pipe P10, chock C1 and pipe P11 to the head unload of the electric coupler EC1. Air pressure is also through the open valve V3, through pipes P10 and P12, through double check valve DCV1 and through pipe P9 to the head piston of the electric coupler EC1. At the same time, air pressure is supplied from the filtered air supply FAS2 through pipes P14, P16 and P18, through the open valve V6, through pipe P22, chock C2 and pipe P23 to the head unlock of the electric coupler EC2. Air pressure is also supplied through the open valve V6, through pipes P22 and P24, through pipe P1 to the head piston of the electric coupler EC2. After a three (3) second time period, the terminals U and U' go low or to a zero voltage level as shown in the uncoupling cycle of FIG. 2. Thus, the coils of valves V3 and V6 are deenergized and are closed to stop the flow of air to head locks and head pistons of the electric couplers EC1 and EC2. Accordingly, the mating connector of the electric contact portions are retracted and will disconnect the trainline connections between car #1 and car #2. After the electrical connectors have been retracted and approximately five (5) seconds after terminal 2 go high, the terminal L of timer T1 will go high for thirty (30) seconds. Thus, the coil of the electromagnetic valve V1 will be energized so that the valve becomes opened. Air pressure will flow for thirty (30) seconds from the filtered air supply FAS, through pipes P1 and P2, through valve V1 and through pipe P7 to the latch cylinder LC1 to uncouple the mechanical couplers. Air also flows from latch cylinder LC1 through pipe P13 to close a tappet brake valve on the mechanical coupler on car #1 to prevent the loss of air and to ensure that the brake will remain released so that the car may be freely pulled by the locomotive or powered car.

On the other hand, when the mating connectors are completely separated, the trainlines to car #2 are disconnected so that the B+ supply voltage is no longer available on lead L8 and therefore the timer T2 is effectively disabled. Thus, the electromagnetic valve V4 is inoperative and no supply pressure is conveyed to the latch cylinder LC2 of car #2. The absence of air pressure to the latch cylinder LC2 allows the tappet brake valve in electric coupler EC2 to stay open long enough after the uncoupling operation to cause the brakes on car #2 to go into an emergency braking mode to ensure that the uncoupled car will not roll away.

Again let us assume that it is desired to uncouple the car #2 from the train and that the attempted uncoupling is initiated by manually operating the key K2 of the key operated switch box KOSB2 on car #2. It will be seen that the turning of the key K2 will immediately open the normally closed contact NC2 so that B+ supply voltage is no longer on car #2. Accordingly, the timer T2 is completely disabled and is incapable of initiating an uncoupling sequence and operation. Thus, the car #2 will remain safely coupled to car #1 so that roll-away is prevented on an inclined section of trackway. It will be seen that when the key K2 is returned to its initial position in which the electrical contact NC2 is closed and electrical contacts NO3 and NO4 are opened, a safe uncoupling process may once again be undertaken by operating the key K1 on car #1.

Thus, the present invention has been described in such full, clear, concise and exact terms as to enable any person skilled in the art to which it pertains to make and use the same, and having set forth the best mode contemplated of carrying out this invention. We state that the subject matter, which we regard as being our invention, is particularly pointed out and distinctly asserted in what is claimed. It will be understood that variations, modifications, equivalents and substitutions for components of the above specifically-described embodiment of the invention may be made by those skilled in the art without departing from the spirit and scope of the invention as set forth in the appended claims.

We claim:

1. An electro-pneumatic coupler control arrangement for safely uncoupling at least one railway car from the end of a train comprising, automatic coupler means carried by each railway car of the train for coupling the railway cars together, electrical means carried by each railway car of the train for supplying electrical power to the respective railway cars of the train manually operated switching means carried by each railway car for interlocking said electrical means on each railway car, timing means carried by each railway car for energizing and deenergizing selected one of a plurality of electromagnetic valves when said automatic coupler means meet and for establishing an uncoupling sequence when said manually operated switching means on the railway car next to the locomotive is actuated and for preventing an uncoupling operation when said manually operated switching means on a railway car remote from the locomotive is actuated so that a railway car remote from the locomotive is incapable of rolling away from the end of the train.

2. The electro-pneumatic coupler control arrangement for safely uncoupling at least one railway car from the end of a train as defined in claim 1, wherein said manually operated switching means includes a plurality of key operated contacts.

3. The electro-pneumatic coupler control arrangement for safely uncoupling at least one railway car from the end of a train as defined in claim 1, wherein said manually operated switching means includes a number of normally opened and normally closed contacts.

4. The electro-pneumatic coupler control arrangement for safely uncoupling at least one railway car from the end of a train as defined in claim 1, wherein each of said plurality of electromagnetic valves is a two-way valve.

5. The electro-pneumatic coupler control arrangement for safely uncoupling at least one railway car from the end of a train as defined in claim 1, wherein said timing means includes a plurality of output terminals.

6. The electro-pneumatic coupler control arrangement for safely uncoupling at least one railway car from the end of a train as defined in claim 1, wherein said manually operated switching means includes at least one normally closed contact and at least two normally opened contacts.

7. The electro-pneumatic coupler control arrangement for safely uncoupling at least one railway car from the end of a train as defined in claim 1, wherein one of said plurality of electromagnetic valves is pneumatically connected to a head piston of an electric coupler during a coupling operation.

8. The electro-pneumatic coupler control arrangement for safely uncoupling at least one railway car from the end of a train as defined in claim 7, wherein another one of said plurality of electromagnetic valves is pneumatically connected to said head piston and a head unlock of the electric coupler during an uncoupling operation.

9. The electro-pneumatic coupler control arrangement for safely uncoupling at least one railway car from the end of a train as defined in claim 8, wherein a further one of said plurality of electromagnetic valves is pneumatically connected to a latch cylinder during the uncoupling operation.

10. A control system for automatic railway car couplers comprising, an automatic coupler including an electrical portion and a pneumatic portion carried by each railway car of a train, a multiple contact switch connected to said electrical portion for supplying power to a timer means, said timer means connected to coils of a plurality of electromagnetic valves which are connected to said pneumatic portion, said multiple contact switch on the railway car following a powered car connecting power to said multiple contact switch of subsequent railway cars so that at least one of said coils of said plurality of electromagnetic valves is energized when the couplers of adjacent cars meet to pneumatically pressurize a head piston on the respective railway cars to cause the railway cars to be coupled together, and said timer means on the respective railway cars sequentially energizing the other of said coils of said plurality of electromagnetic valves when an uncoupling operation is initiated by the manipulation of said multiple contact switch on the railway car following the powered car to pneumatically pressurize the head piston and a head unlock and also to pneumatically pressurize a latch cylinder to prevent brakes on the railway car following the powered car from being applied and also for preventing the pneumatic pressurizing of a latch cylinder on the subsequent railway cars so that their brakes are applied.

11. The control system for automatic car couplers as defined in claim 10, wherein said multiple contact switch includes a least one normally closed contact and at least two normally opened contacts.

12. The control system for automatic car couplers as defined in claim 10, wherein the head unlock and head piston are pneumatically pressurized through a double check valve.

13. The control system for automatic car couplers as defined in claim 10, wherein said pneumatic portion is connected to a filtered air supply.

14. The control system for automatic car couplers as defined in claim 10, wherein said multiple contact switch is a key operated switching device.

* * * * *